United States Patent [19]

Dyche et al.

[11] 4,043,078

[45] Aug. 23, 1977

[54] PLUG DOOR FOR A RAILROAD FREIGHT CAR

[76] Inventors: Kenneth I. Dyche, 2120 S. Pleasant Valley Road, Srpingfield, Mo. 65804; J. Paul Knox, 5249 Clayhill Drive, Springfield, Mo. 65804; Ronald I. Swearengin, 4806 S. Fremont, Springfield, Mo. 65807

[21] Appl. No.: 665,905

[22] Filed: Mar. 11, 1976

[51] Int. Cl.[2] ..... E05D 15/10

[52] U.S. Cl. ..... 49/220

[58] Field of Search ..... 49/220, 219, 218, 217, 49/216, 426

[56] References Cited

U.S. PATENT DOCUMENTS

| | | | |
|---|---|---|---|
| 2,031,040 | 2/1936 | Haseltine | 49/220 |
| 2,453,793 | 11/1948 | Hveem | 49/219 |
| 3,029,747 | 4/1962 | Shaver | 49/177 X |
| 3,913,269 | 10/1975 | Ross, Jr. | 49/220 |

*Primary Examiner*—Philip C. Kannan

*Attorney, Agent, or Firm*—Kinzer, Plyer, Dorn, & McEachran

[57] ABSTRACT

The plug door of a railroad freight car is restrained against falling by elongated slide members in the upper track connected to the crank operating rod.

1 Claim, 2 Drawing Figures

Fig. 1.
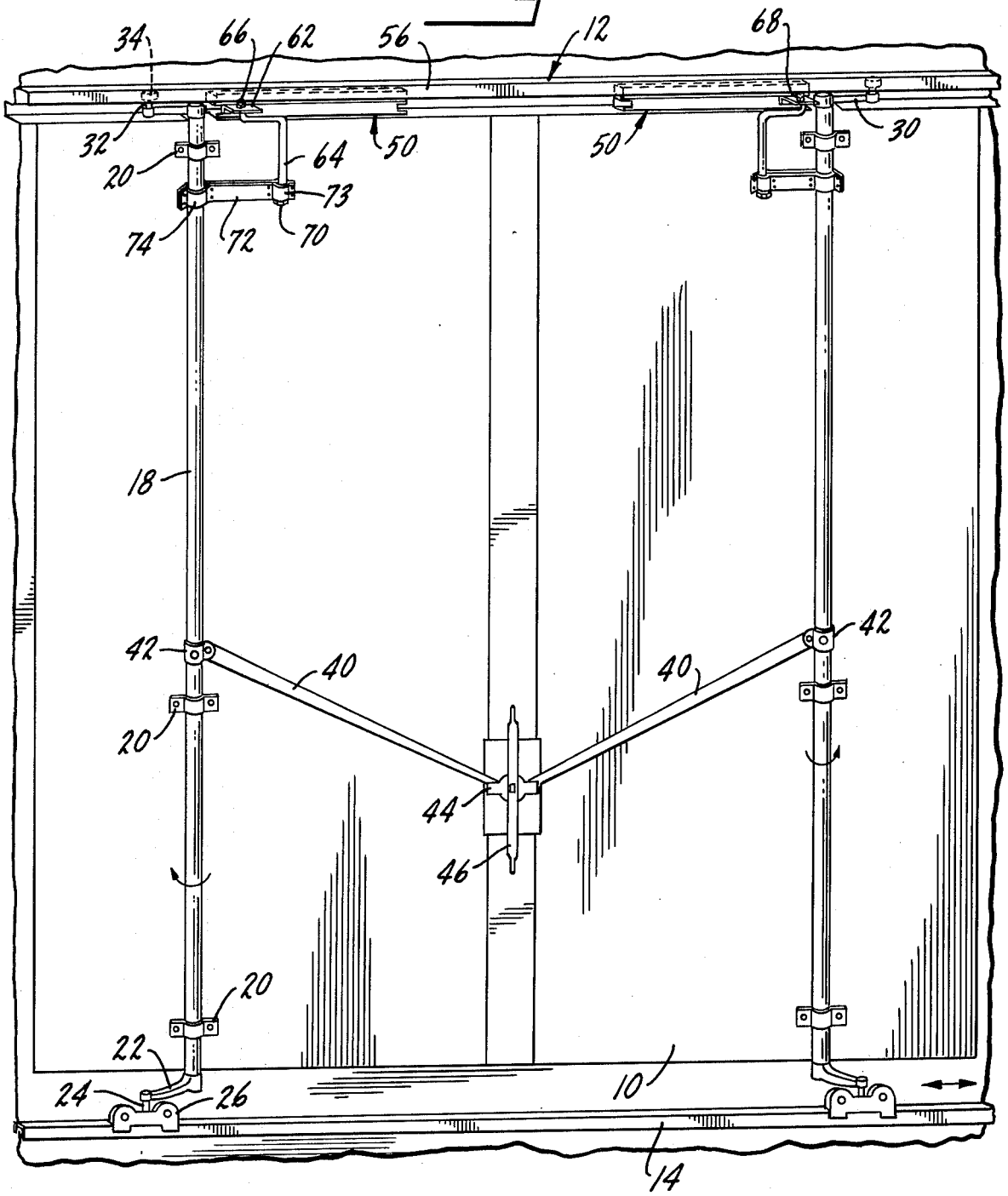
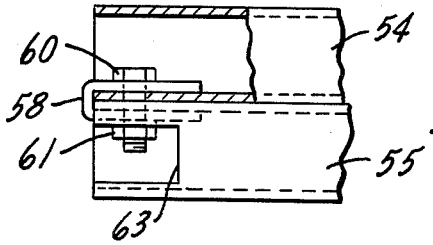
Fig. 2.

PLUG DOOR FOR A RAILROAD FREIGHT CAR

This invention relates to a plug door for a railroad freight car and in particular to an improvement therein to save lives, characterized by a device to restrain an otherwise faulty door, loose in the door opening, from falling outward and crushing the attendant.

Faulty plug doors are responsible for a number of accidental deaths each year. The door, when moved outward of the car door opening incidental to sliding it laterally along upper and lower tracks, hangs by a pair of crank arms. If the crank arms break or loosen, the door literally falls outward, and being quite heavy can crush or maim the attendant, which indeed happens. The fact that the door is supported by a bottom track is no deterrent because if the upper connections are disabled there is no resistance to a gravity fall.

The object of the present invention is to reduce the likelihood of such accidents and to accomplish this by interposing a restraining member between parts already present. Specifically it is an object of the present invention to interpose a strong slide member of generous length in the upper track and to connect the slide member by an articulated linkage to one of the operating rods which is secured to the door. Therefore, if a crank arm or its connections are broken, the door is still supported in the upper track.

In the drawing:

FIG. 1 is an elevation of a railroad car plug door constructed in accordance with the present invention;

FIG. 2 is a detail view showing the manner in which the slide members are constructed.

The plug door 10, FIG. 1, and the operating principle by which it is moved in and out of the door opening are known. One form of construction, for example, is disclosed in U.S. Pat. No. 2,658,243. Details may vary somewhat, such as in U.S. Pat. No. 3,913,269 where, in addition, the safety problem is proposed to be answered by an extra crank and roller which is quite inadequate to impart stability in the event both operating cranks fail and certainly inadequate to support the entire door by itself in the event the bottom track collapses.

Therefore, for purposes of the present disclosure, only a limited explanation of the door operating principle will be set forth.

The door 10 is disposed between an upper track 12 and a lower track 14 secured to the side of the car, not shown. Two upright crank operating arms are rotatably supported by brackets 20 fastened to the door.

A lower horizontal crank 22 is fixed at one end to the lower end of each rod so as to rotate therewith and each crank 22 at the opposite end has a downwardly extending spindle 24 pivotally connected to a carriage 26 travelling on the lower horizontal track 14.

A horizontal upper crank 30 is fixed to the upper end of each rod 18. Each crank 30 has an upwardly extending spindle 32 rotatably mounted in a roller 34 captured by the upper horizontal track 12.

A lever 40 is fastened to each crank operating rod, as by securing the outer end of each lever to a clevis 42 in turn pinned to the related crank operating arm. By moving the levers 40 in unison toward the observer, the operating rods are turned as shown by the arrows. The rods 18 in effect are fulcrumed on the crank spindles which cannot be displaced outwardly or inwardly of the tracks; as a consequence the rods 18 and the door attached thereto by the brackets 20 move bodily outwardly of the door opening and the door may then be moved laterally left or right along the tracks 12 and 14.

The levers 40 may be operated in unison by a follower 44 actuated by a screw (not shown) turned by a handle 46, as explained in U.S. Pat. No. 2,658,243. Thus, the end of each lever 40 opposite its clevis 42 is connected to the follower 44 so that outward movement of the follower forces the levers 40 outwardly toward the observer.

If, in the course of moving the door, one of the upper cranks is dislodged or experiences separation relative to the upper track, or if the weight of the door otherwise exceeds the limits of its support, the door may fall outward. Failure in the lower track can be involved in the same result because then the weight of the whole door is born by the rollers 34.

To reduce this possibility, we arrange a pair of sturdy, elongated slides 50 inside the upper track and link these slides to the upper end portions of the operating rods. In this connection it will be noted the upper track is generally rectangular in cross-section but is provided with an outwardly opening throat which is present for the purpose of operatively assembling the upper crank arms and their track rollers. We take advantage of this throat to assemble the slides and we also take advantage of the standard track and operating rods to anchor the restraining means of the present invention interposed therebetween.

Thus, each slide member 50 comprises a pair of square tubes 54 and 55, FIG. 2, placed inside the upper track and then attached together in juxtaposed relationship. The tubes 54 and 55 may be 1½ inches square (to complementally fit in and be restrained by the track) and 24 inches long so that together they constitute a supporting length of approximately 48 inches inside the upper track. When thus assembled the upper vertical flange 56 of the track 12 prevents outward displacement of the slide members 50 and of course the slide members are free to travel in the upper track.

The two tubes may be joined in any preferred manner but preferably we employ a U-shaped clip 58, embracing the engaged surfaces of the tubes at opposite ends of the assembly. A bolt 60 is passed through aligned apertures at the inner ends of the leg of the clip and a nut 61 is secured to the threaded end of the bolt. A cutout opening 63 in the lower tube 55 enables a wrench to be inserted incidental to tightly securing the square tubes.

As noted above, each of the slides 50 restrained by the track is connected to the related crank operating arm 18. To accomplish this, the lower square tube 55 incorporated in each slide member 50 has an outwardly extending flange or attaching bracket 62 secured thereto adjacent the related operating rod 18. A support rod 64 has a threaded end 66 disposed in an opening in the bracket 62. A nut 68 is applied and locked so that the support rod 64 depends therefrom.

The support rod 64 is bent in the manner shown so that it will clear one side of the operating rod 18. The support rod 64 may be in the form of a long bolt having a head 70 serving as an abutment for a connecting arm 72 which at one end has an eye 73 pivotally mounted on the support rod 64 above the head 70 thereof. The arm 72 at the opposite end has an eye 74 pivotally surrounding the operating rod 18. In this manner, arm 72 is articulated to rod 64 and to rod 18 as well so that when the plug door is moved outwardly or inwardly of the door opening there is no interference by the linkage 64–72.

It will be noted eye 74 of arm 72 is located immediately beneath one of the brackets 20 which fastens the crank operating rod to the door. If all support is lost, save the support afforded by the slide member 50, including the restraint of the lower track, the downward drop of the door is limited by brackets 20 engaging the eye elements 74.

The door is therefore restrained by the elongated track-secured slides 50 linked to the crank operating levers which are carried by the door.

To practice the invention no part of the door is altered and no part of the track is altered. It is a matter of inserting the slides and coupling the slides to the crank operating rods, preferably by a linkage having articulated joints so that the supports which restrain the door from falling will not interfere with normal movement of the door.

The geometry of the link 64–72 may vary of course and this is equally true of the slide members and manner in which the connections are made.

We claim:

1. In a railroad freight car plug door and supporting structure which includes a door adapted to plug a door opening in the side of the car and wherein the door is moved outward and inward of the door opening by means of cranks fixed to the opposite ends of crank operating rods rotatably supported by brackets mounted on the door, the cranks having arms pivotally supported on means travelling on tracks located above and below the door opening, the upper track being of rectangular cross-section, whereby rotation of the rods swings the cranks which pivot at the tracks to move the door in or out, the improvement characterized by a pair of elongated slide members located in the upper track to travel therein, each slide being a tubular member having a cross-section complemental to that of the upper track, and a linkage pivotally attached at one end to each slide and pivotally secured at the other end to the upper portion of a related operating rod, each linkage being so secured beneath a bracket supporting the related rod on the door.

* * * * *